US007121786B2

(12) United States Patent
Yonehara

(10) Patent No.: US 7,121,786 B2
(45) Date of Patent: Oct. 17, 2006

(54) MIX-IN STRUCTURE FOR GAS OR THE LIKE IN PRESSURIZATION CENTRIFUGAL PUMP

(75) Inventor: Ryoichi Yonehara, Shimane (JP)

(73) Assignee: Yonehara Giken Co., Ltd., Shimane (JP)

( * ) Notice: Subject to any disclaimer, the term of this patent is extended or adjusted under 35 U.S.C. 154(b) by 82 days.

(21) Appl. No.: 10/519,688

(22) PCT Filed: Jul. 24, 2003

(86) PCT No.: PCT/JP03/09366

§ 371 (c)(1),
(2), (4) Date: Jan. 10, 2005

(87) PCT Pub. No.: WO2004/011811

PCT Pub. Date: May 2, 2004

(65) Prior Publication Data

US 2005/0175449 A1 Aug. 11, 2005

(30) Foreign Application Priority Data

Jul. 25, 2002 (JP) ..... 2002-216857

(51) Int. Cl.
*F04D 29/46* (2006.01)
*F04D 5/00* (2006.01)

(52) U.S. Cl. ..... 415/29; 415/55.1

(58) Field of Classification Search ..... 415/55.1, 415/55.4, 58.8, 26, 49; 416/27, 42, 61, 159
See application file for complete search history.

(56) References Cited

U.S. PATENT DOCUMENTS 3,100,964 A * 8/1963 Bevers et al. ..... 415/26
6,152,687 A * 11/2000 Wilhelm et al. ..... 415/55.1
6,527,506 B1 * 3/2003 Pickelman et al. ..... 415/55.1
6,659,713 B1 * 12/2003 Fujii et al. ..... 415/55.1

FOREIGN PATENT DOCUMENTS

| | | |
|---|---|---|
| JP | 58-68000 | 5/1983 |
| JP | 2-105598 | 8/1990 |
| JP | 9-119396 | 5/1997 |
| JP | 10-196580 | 7/1998 |
| JP | 2000-230492 | 8/2000 |
| JP | 2002-089477 | 3/2002 |

OTHER PUBLICATIONS

English language Abstract of JP2002-089477.
English language Abstract of JP 2000-230492.
English language Abstract of JP 10-196580.
English language Abstract of JP 9-119396.

* cited by examiner

*Primary Examiner*—Igor Kershteyn
(74) *Attorney, Agent, or Firm*—Greenblum & Bernstein, P.L.C.

(57) ABSTRACT

A mix-in structure for a gas or the like in a pressurization centrifugal pump, capable of mix-discharging liquid and gas or the like to prevent cavitation and of suppressing gas residence in the pump chamber at the time of operation stoppage or the like. It comprises a drum-like case having a suction port and a delivery port, in which opposedly disposed are a vane wheel radially formed with a plurality of vanes, a pressurization surface formed with a compression chamber opposed to the vane wheel and converging from the suction port toward the vanes, and pressurization section formed with a pressurization partition wall disposed close to the side surfaces of the vanes to prevent leakage of the fluid in the vane chamber, wherein a gas supply device is installed for supplying a gas into the suction port by an increase in the liquid pressure in the delivery port by using a pressurization centrifugal pump for pressurizing the liquid taken in from the suction port in a pump chamber defined by the vane wheel and the pressurization section and delivering it through the delivery port.

8 Claims, 10 Drawing Sheets

MIX-IN STRUCTURE FOR GAS OR THE LIKE IN PRESSURIZATION CENTRIFUGAL PUMP

FIELD OF APPLICATION

The invention relates to a centrifugal compressor pump wherein an impeller wheel draws in gas and liquid through an intake duct and expels said gas and liquid through a discharge duct.

PRIOR ART

Centrifugal pumps that draw in and discharge air, water, oils and the like draw in and discharge fluids only through the accelerated rotation of an impeller wheel in a case, thus making it difficult to increase the pressure of the discharge fluid in respect to the flow volume. The applicant has disclosed an improved type of centrifugal pressurization pump in Japanese Patent Publication (Kokai) No. 2002-89477.

The centrifugal pressurization pump disclosed in this patent publication includes a drum-shaped case containing an intake port and a discharge port, an impeller wheel formed of multiple radially disposed impeller vanes, a pressure face forming a narrowing compression chamber extending from the intake port and facing the impeller wheel, and a pressure block forming a separation wall that stops leakage of the fluid in the impeller chamber in the vicinity of the impeller vanes. The fluid entering from the intake port is compressed within the pump chamber formed by the impeller wheel and pressure block, and expelled from the discharge port.

The above-described prior art centrifugal pressurization pump draws in water from the intake port, infuses the air into the water under pressure within the pump chamber, and discharges the air-infused fluid (a mixture of air and water) from the discharge port. For example, when used to wash fishing nets soiled with dirt or stubbornly adhered substances, this centrifugal pressurization pump exhibits the shortcomings of not being able to uniformly mix the air and liquid components due to the large bubbles of air infused into the liquid, and also due to easily generated cavitation.

Also, when the centrifugal pressurization pump described by the aforesaid patent attempts to infuse air into the fluid, small air bubbles mix into the fluid in the pump chamber through agitation. Although this can provide a more efficient washing action and an increase in the volume of dissolved oxygen, noise is generated by the action of the air moving around the pump chamber during the compression process.

Therefore, regardless of the type of pump, and excluding other restrictions to the discharge duct system such as the connection of a hose and nozzle to the discharge duct, changes in the state of the pressurized fluid, induced by speed fluctuations of the impeller wheel from running start until stop, result in errors in the timing and amount of air supplied to the fluid, thus adversely affecting the discharge performance of the air-fluid mixture and making control difficult.

DISCLOSURE OF THE INVENTION

The present invention resolves the aforesaid shortcomings through a gas infusion structure for a centrifugal pressurization pump that operates by drawing in fluid from intake port 2, compressing the fluid within pump chamber 9 defined by impeller wheel 5 and pressure block 16, and expelling the fluid from discharge port 3. The centrifugal pressurization pump includes impeller wheel 5 formed of multiple radially disposed impeller vanes 19, impeller wheel 5 being installed within drum-shaped case 4 within which intake port 2 and discharge port 3 are provided; pressure face 36 formed by narrowing compression chamber 33 which extends from intake port 2 which opposes impeller wheel 5, and which faces impeller vanes 19; and pressure separator wall 35, formed on pressure block 16, which prevents leakage of fluid from impeller chamber 27 from the side adjacent to impeller vanes 19.

The centrifugal pressurization pump is firstly characterized by gas infusion unit 6 which supplies gas to intake port 2 based on an increase in fluid pressure at the aforesaid discharge port 3.

The centrifugal pressurization pump is secondly characterized by constricting device 70 which is installed to discharge duct 20 which in turn connects to discharge port 3, the purpose of constricting device 70 being to increase the fluid pressure in pump chamber 9.

The centrifugal pressurization pump is thirdly characterized by relief valve 75 which is installed to discharge duct 20, the purpose of relief valve 75 being to prevent the fluid pressure in pump chamber 9 from exceeding a specified value.

The centrifugal pressurization pump is fourthly characterized by pressure differential ridge 39 which is formed on compression face 36 between intake port 2 and pressure separator wall 35, and which provides a steeply inclined surface that induces a sudden change in flow direction of the fluid and gas toward impeller vanes 19.

BRIEF DESCRIPTION OF THE DRAWINGS

The following will describe embodiments of the present invention with reference to the drawings. Referring to FIGS. 1 through 4, pump 1 is a centrifugal pressurization pump equipped with the gas infusion structure described by the invention. Pump 1 includes drum-shaped case 4 in which are installed intake port 2 and discharge port 3, impeller wheel 5 rotatably supported within case 4, and gas infusion unit 6 which supplies a gas, such as air and the like, to the internal region of case 4.

Figure 1:
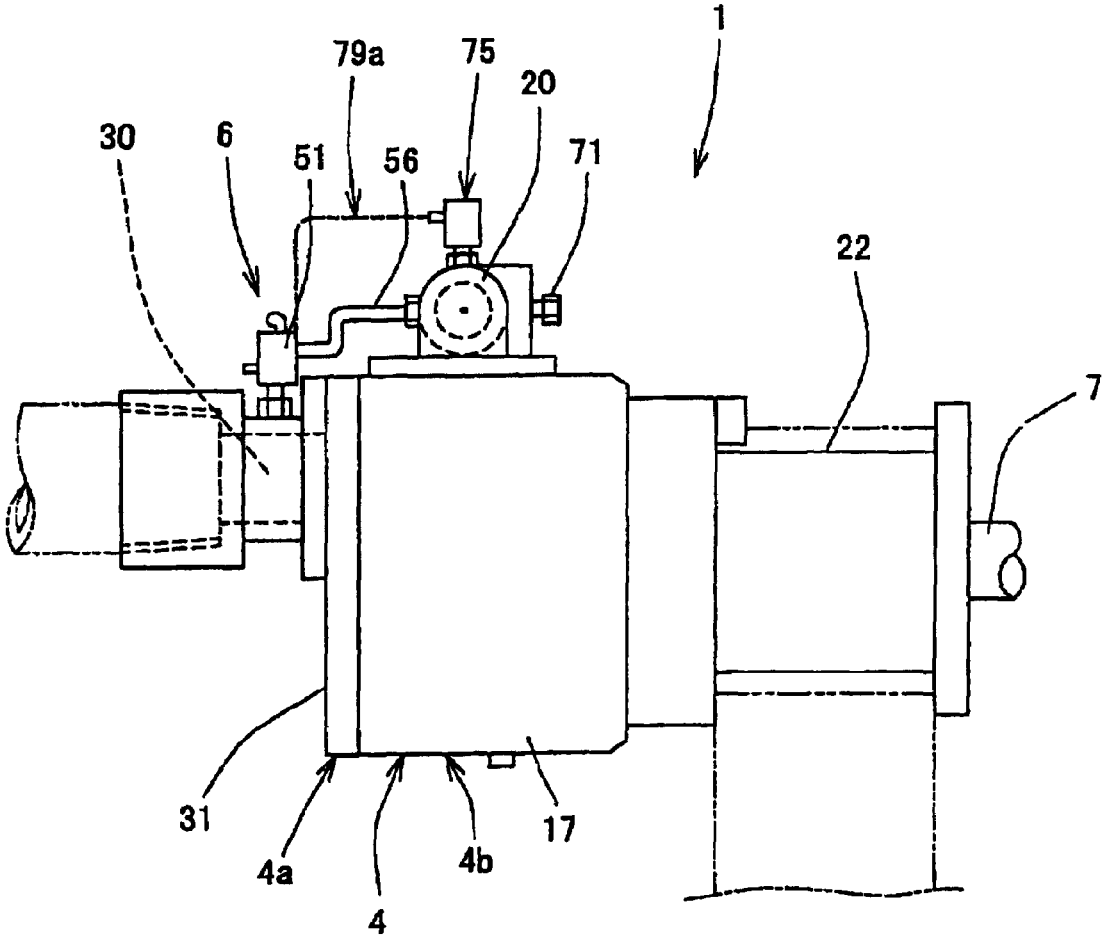
FIG. 1 is a plan view of a centrifugal pressurization pump into which the gas infusion structure described by the invention is incorporated.
Figure 2:
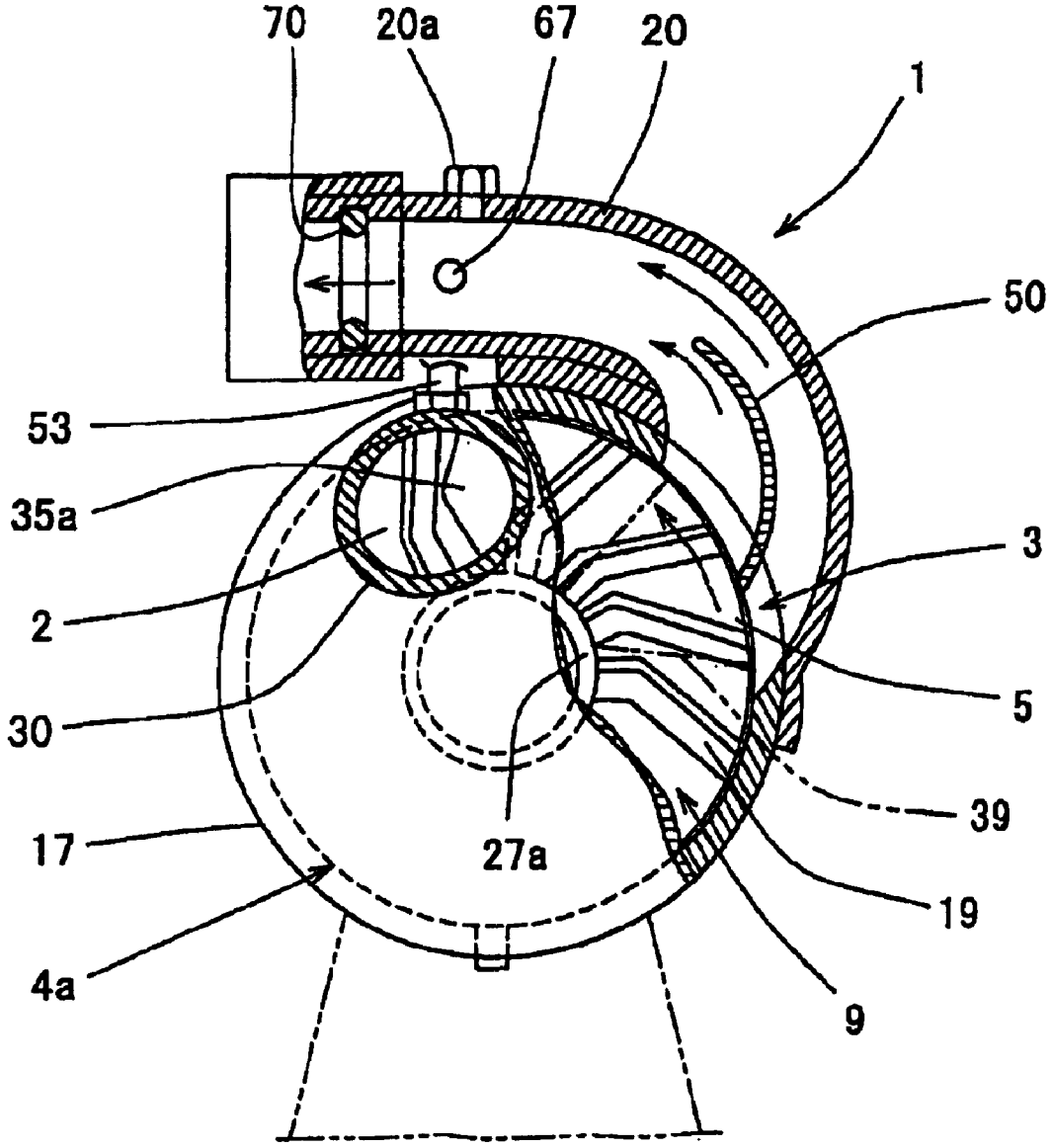
FIG. 2 is a partial cross section of the left side of the pump chamber of the FIG. 1 pump.

In pump 1, impeller wheel 5 is driven by a motor attached to one side of pump shaft 7 in the direction indicated by the arrow in FIG. 2. A liquid such as water, oil or the like, or a gas such as air and the like, or a gas or liquid into which a medicinal substance or powder has been infused, is drawn into pump chamber 9 of case 4 through intake port 2, agitated and pressurized while the gaseous component is mixed into the liquid component, and expelled from discharge port 3.

The following will provide a detailed description of the structure and its operation. Moreover, this embodiment will be described using water as the liquid and air as the infusion gas.

Firstly, as shown in the drawings, case 4 is divided into a pair of left and right cases in the form of pressure case 4*a* which includes intake port 2, and impeller wheel case 4*b* which includes discharge port 3. Pump chamber 9 is formed as a sealed space by joining the aforesaid cases together with screws or other like fasteners at multiple locations with O-ring seal 10 and abrasion-resistant seal 11 (to be described later) placed between the opposing mating surfaces.

Impeller wheel case 4*b* is a one-piece structure comprising perimeter wall 17 which has a width equal to that of pressure block 16 of pressure case 4*a* (to be subsequently described) inserted therein, and impeller wheel 5 at the external circumference of disc-shaped sidewall 15. Perimeter wall 17 is formed to a width and depth corresponding to the width and depth of multiple impeller vanes 19 of impeller wheel 5 which is disposed at a specific location opposite discharge port 3. Discharge duct 20 is a narrowing crescent-shaped channel that forms a single structure with discharge port 3.

Moreover, support brackets 21 and 22 connect to form a single structure supporting pump shaft 7 at the external side of sidewall 15. Bracket 22 supports the left and right-side bearings 23 of pump shaft 7 which is located at the center of pump chamber 9. Component 23*a* is a sealing plate provided at the bearing 23 side of bracket 22. Components 23*b* is a mechanical seal, and 24 is a drain hole.

Impeller wheel 5, which includes multiple impeller vanes 19 arranged in a concentric radial pattern thereon, is removably attached to the end of pump shaft 7 within pump chamber 9 through fastener 25 which may be a screw, nut, or like fastening device. Impeller plate 26 and impeller vanes 19 maintain respective close proximity, through small gaps, to sidewall 15 and perimeter wall 17 respectively.

Figure 5:
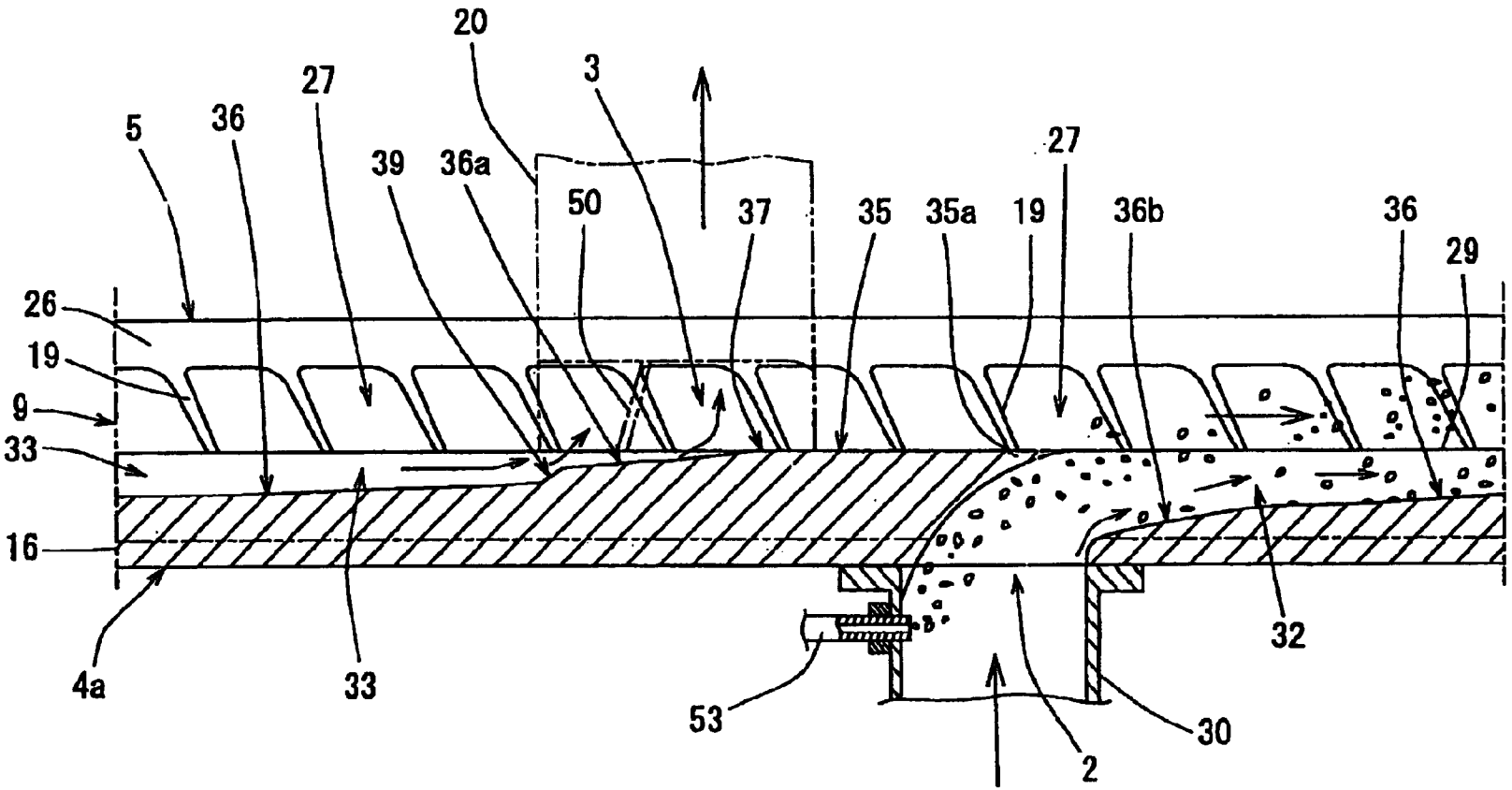
FIG. 5 is a cross sectional view illustrating the operation of the pump chamber.

Impeller wheel 5, as shown in FIGS. 2 and 5, is a one-piece structure that includes impeller vanes 19, impeller plate 26 formed as a disc-shaped impeller sidewall, if formed as a one-piece structure on one side of boss 27*a* which also serves as an attaching part to pump shaft 7. Impeller vanes 19 extend in a radial pattern, at specific intervals, from boss 27*a* and along impeller plate 26. Impeller chamber 27 is formed as each region between impeller blades 19 which encapsulate the fluid media.

Impeller vanes 19, which are arranged in a radial pattern on impeller wheel 5, are approximately straight surfaces rearwardly inclined toward the upstream side of the rotating impeller wheel (hereafter referred to as the upstream side). A scooping angle is formed at pressure case 4*a* by the edge of each impeller vane 19 being further extended than its base part toward the downstream side of the rotating impeller wheel (hereafter referred to as the downstream side).

This configuration allows the rotation of impeller wheel 5 to more easily draw in fluid from intake port 2, hold the rotating fluid within impeller chambers 27, and applies additional centrifugal force, generated by the rearwardly inclined impeller blades, while the fluid within each impeller chamber 27 is carried toward discharge port 3, thus increasing the fluid output pressure in the radial direction and improving pumping efficiency.

Moreover, with impeller wheel 5 installed within impeller wheel case 4*b*, boss 27*a* and the ends of impeller vanes 19 are the approximate same height as the flat end surface of divider wall 29 and in close proximity thereto, divider wall 29 being formed around the center of pressure case 4*a* (which will be subsequently described). Anti-abrasion seal 11 is installed between the two components. Multiple thru-holes 26*a* penetrate impeller vane plate 26 at appropriate locations to allow the passage of fluid from impeller chamber 27 to mechanical seal 23*b*.

Figure 3:
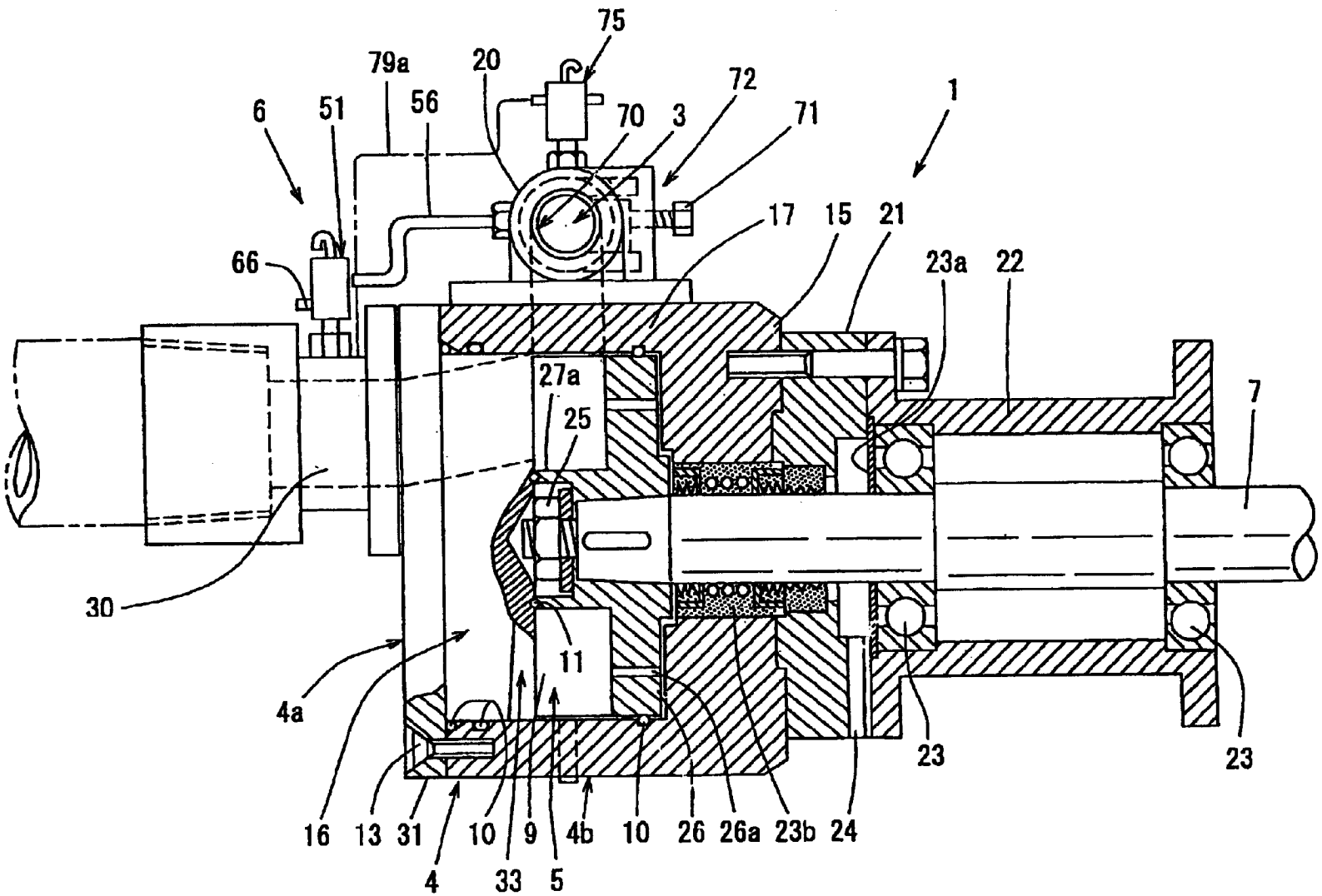
FIG. 3 is a cross section of the pump chamber of the FIG. 1 pump.
Figure 4:
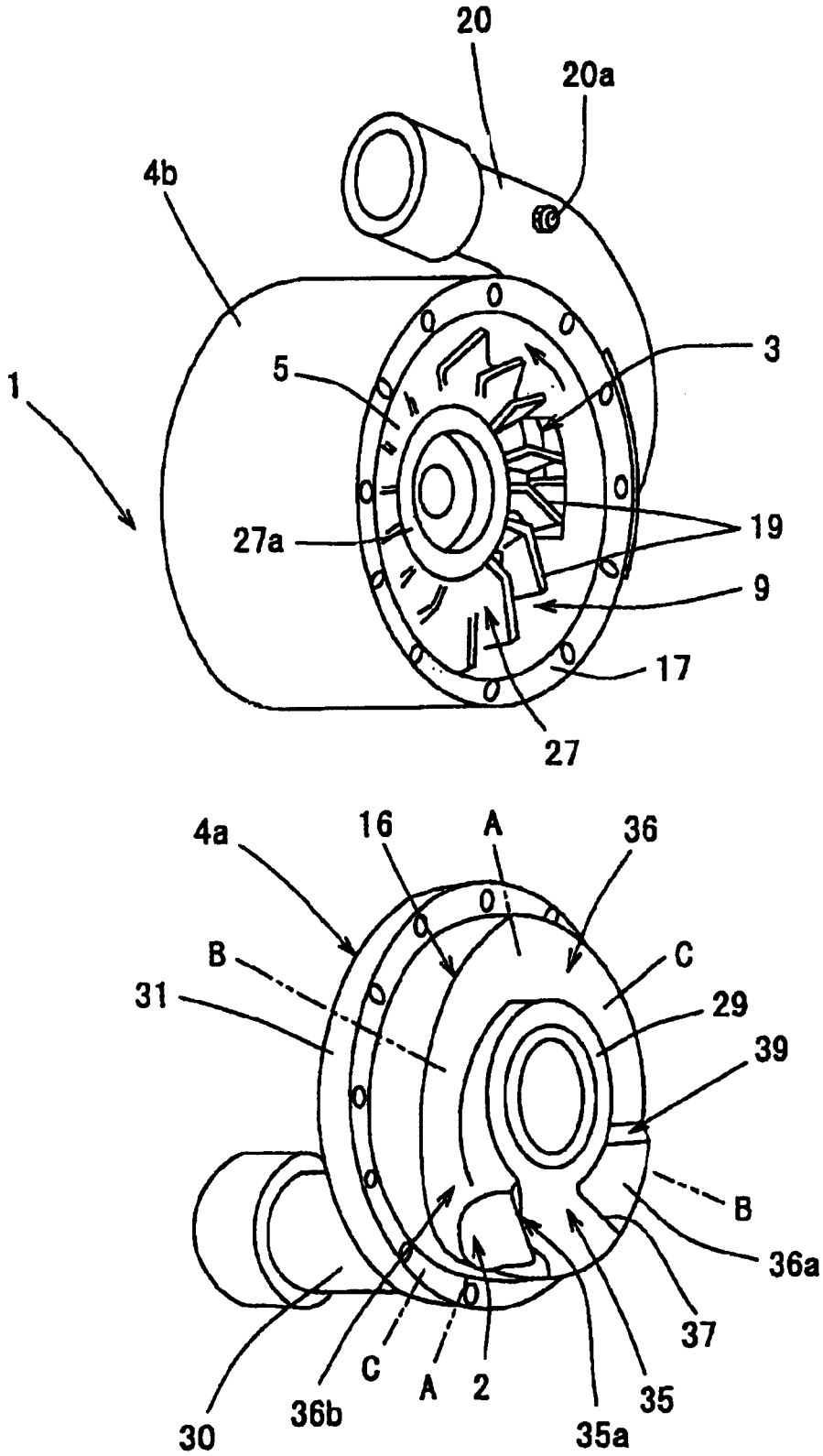
FIG. 4 is a perspective view of the structure of the case of the FIG. 1 pump.

The following will describe pressure case 4*a* with reference to FIGS. 3 through 5 (note: FIG. 5 is an illustration showing the operating relationship between compression chamber 33 and impeller vanes 19 with discharge duct 20 and guide 50 oriented at 90° to the pump shaft. Pressure case 4*a* forms a single structure with case cover 31 on which are formed intake duct 30 and pressure block 16. With pressure block 16 placed within the opening of impeller wheel case 4*b* in which impeller wheel 5 resides, case 4 is sealed by securing case cover 31 to perimeter wall 17 with fasteners 13.

Pump chamber (pressure chamber) 9 is thus structured to allow impeller wheel 5 to draw in a largely unimpeded flow of fluid from intake port 2, compress the fluid between pressure block 16 and impeller wheel 5, and expel the fluid from discharge port 3.

In other words, as shown in FIG. 5, pump chamber 9 includes intake chamber 32 which connects to intake port 2 at the beginning of the upstream portion of chamber 9 and promotes fluid intake, and compression chamber 33 which compresses the fluid at the end of the downstream portion of chamber 9. Also, pressure divider wall 35, which separates intake chamber 32 from compression chamber 33 and prevents leakage of fluid from impeller chambers 27, is formed between the end of compression chamber 33 and the beginning of intake chamber 32, the flat surface of pressure divider wall 35 being formed on the same plane as that of divider wall 29.

Intake chamber 32, compression chamber 33, and pressure divider wall 35 thus interconnect to form a continuous structure around divider wall 29 around the edge face of boss 27*a* of impeller wheel 5.

Compression face 36, which is formed on the inner face of pressure block 16 in the region extending from intake port 2 to pressure divider wall 35, is structured as an inclined surface (to be subsequently explained) extending in the rotational downstream direction of impeller wheel 5. Compression face 36 inclines gradually upward from intake chamber 32 in proximity to the edge faces of impeller vanes 19, thus creating a narrowing passage that forms compression chamber 33.

As a result of this structure, the fluid coming into pump chamber 9 from intake port 2 is held within each impeller chamber 27 and increasingly pressurized in compression chamber 33 by multiple impeller vanes 19 which accelerate and discharge the fluid in a radial direction.

Compression chamber 33 extends up to compression termination point 37 which is located at the leading edge of pressure divider wall 35. The fluid from intake chamber 32, which has been accelerated in the rotational downstream direction, is directed along compression face 36 within impeller chamber 27, pressurized within pump chamber 9 without sudden compressive friction or other impedance, and expelled from discharge port 3 as pressurized fluid.

As shown in FIGS. 2, 4 and 5, pressure differential ridge 39 is formed on compression face 36, at a location along divider wall 35 after intake port 2, as an inclined step-like surface that suddenly narrows the path through which impeller vanes 19 direct the fluid and gas. Second compression face 36*a*, which is a narrowing wedge shape in cross section, is formed between pressure differential ridge 39 and pressure divider wall 36.

Pressure differential ridge 39, which is located at the leading edge of discharge port 3 on the upstream side of compression termination point 37, accelerates the flow of fluid during its passage through compression chamber 33, and as a result of its location at discharge port 3 in pump chamber 9, has the effect of preventing a drop in fluid pressure which would otherwise occur during fluid discharge. This structure also has the effect of smoothly pressurizing and discharging the air supplied by gas infusion unit 6, and of suppressing noise and cavitation which can result from infused air.

In other words, pressure differential ridge 39 extends outward from divider wall 29 in the radial direction in respect to compression face 36, and inclines downward in the rearward direction upstream from the rotating impeller wheel.

Moreover, as shown in FIG. 5, pressure differential ridge 39 may extend outward from divider wall 29 as an inclined flat surface or smoothly radius surface, when viewed in radial cross section, facing the rotational downstream side. Formed as an inclined surface that rises from compression face 36 toward the outwardly facing edges of impeller vanes 19, pressure differential ridge 39 provides a smooth transition between pressure face 36 and $2^{nd}$ pressure face 36*a*.

As a result of this structure, the fluid entering from intake port 2 is pressurized along a spiral path within impeller chambers 27, and the bubbles created by the infusion of air are reduced to an extremely small size while the fluid is driven in a circular path by impeller vanes 19, through narrowing compression chamber 33, while being increasingly pressurized against pressure face 36.

Therefore, due to the presence of pressure differential ridge 39, the fluid and air bubbles flow smoothly along pressure face 36 without being subjected to frictional shocks, thus the direction of flow is smoothly altered and directed toward impeller vanes 19 into impeller chambers 27.

Therefore, the air bubbles flowing toward compression termination point 37 along pressure face 36 are quickly forced into impeller vane chambers 27 after having been reduced to smaller bubbles by mixing into the flow where it separates from pressure face 36. From here the flow moves toward discharge port 3 from $2^{nd}$ compression face 36*a* which gradually approaches impeller vanes 19. The result is that noise is suppressed by the large amount of air bubbles that have entered the spaces between the edges of impeller vanes 19 and pressure divider wall 35 after compression termination point 37. Furthermore, wear on impeller blades 19, which is normally caused by the air bubbles rupturing, is prevented.

Moreover, as shown in FIG. 5, it is preferable that pressure differential ridge 39 be located opposite discharge port 3 on the upstream side for the efficient discharge of air bubbles.

Furthermore, because the air supplied by gas infusion unit 6 does not remain within pump chamber 9 for an extended period of time, but is expelled from discharge port 3 at each revolution, the air infusion and discharge action within pump 1 is improved and cavitation prevented.

The following will describe pressure divider wall 35. The rearward portion of pressure divider wall 35 includes pressure divider wall extension 35*a* which is formed as a thinly extended part of pressure divider wall 35 in proximity to impeller vanes 19. As shown in FIGS. 2 and 5, pressure divider wall extension 35*a* is located at the entrance to intake chamber 32, and when viewed from the side, appears a gradually narrowing pointed portion extending over intake port 2, the underside of pressure divider wall extension 35*a* forming a narrowing smoothly radiused opening that serves as an intake flow directing surface at the entrance to intake chamber 32.

This structure increases the surface area of pressure divider wall 35 as much as possible without shortening the length of the wall on the pressure chamber 33 side, and thus adequately maintains fluid pressure and increases intake efficiency.

Also, the surface opposing the aforesaid intake flow guide surface at the beginning of compression face 36 is formed as intake guide face 36*b* which is somewhat more acutely inclined than the inclined surface on the downstream side, thus increasing efficiency by reducing resistance to and aiding the initial intake of fluid on the rotational downstream side of impeller wheel 5.

Furthermore, fluid intake volume is enhanced and intake resistance reduced by forming intake port 2 as an oval shape with the long axis aligned along the rotating direction of impeller wheel 5 as shown in FIG. 2.

Because the fluid is increasingly compressed in a direction toward the radially inner portions of impeller chambers 27, which are formed as radial cavities defined by rearwardly inclined impeller vanes 19 in mutual juxtaposition, load shocks applied by the fluid against impeller wheel 5 are suppressed due to the fluid not being suddenly pressurized, and the pressurization of all the fluid within impeller chamber 27 is promoted and maintained, thereby expelling the fluid at discharge port 3 at maximum fluid pressure, and thereby expelling a large volume of fluid with greater force and centrifugal extraction.

Figure 8A:
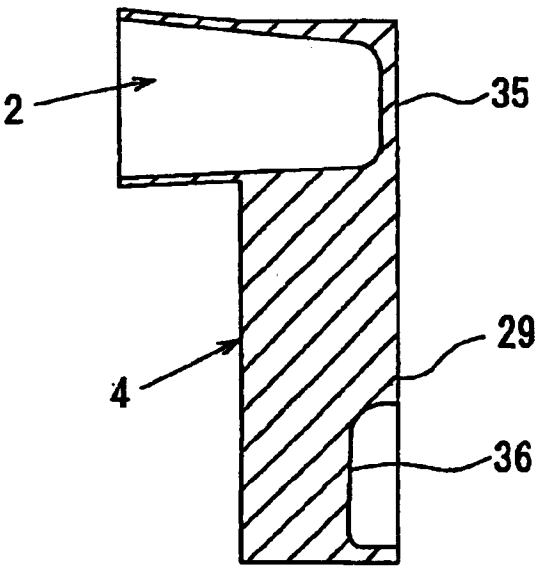
FIG. 8 provides three cross sectional views of the working part of the compression chamber. The A, B, and C views are taken from lines A—A, B—B, and C—C respectively in FIG. 4.
Figure 8B:
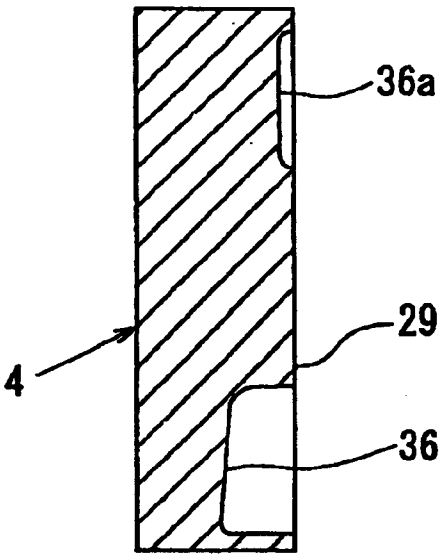
Figure 8C:
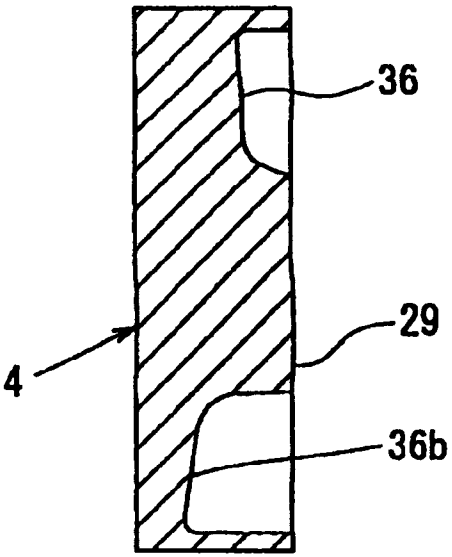

Moreover, compression chamber 33 is formed as a continuation of planar-shaped pressure divider wall 35 opposing multiple impeller chambers 27, and because pressure divider wall 35 prevents leakage of the fluid held within multiple impeller chambers 27 at the region where compression terminates, the pressure in compression chamber 33 is maintained and thus assures a strong discharge of fluid. Pressure chamber 33 is shown in cross section in FIG. 8 for reference purposes.

The following will describe discharge port 3 of impeller wheel case 4*b*. Discharge port 3 is located at the end of compression chamber 33. In other words, discharge port 3 is formed as an elongated opening in perimeter wall 17 of impeller wheel case 4*b* opposite to pressure differential ridge 39, $2^{nd}$ pressure face 36*a*, and pressure divider wall 35.

Guide vane 50 is formed within discharge port 3 in the lengthwise direction in order to direct the exiting fluid. Pressure block 16 is structured to reduce flow resistance and provide maximum pump performance in respect to fluid type, the number of impeller vanes 19, and other factors. For example, structuring pressure block 16 as a crescent shape has the effect of smoothly and gradually directing fluid flow downstream in a coherent state while preventing upstream turbulence. The exiting fluid is directed to an external device by discharge duct 20 which can be removably attached to the external side of perimeter wall 17.

Figure 6:
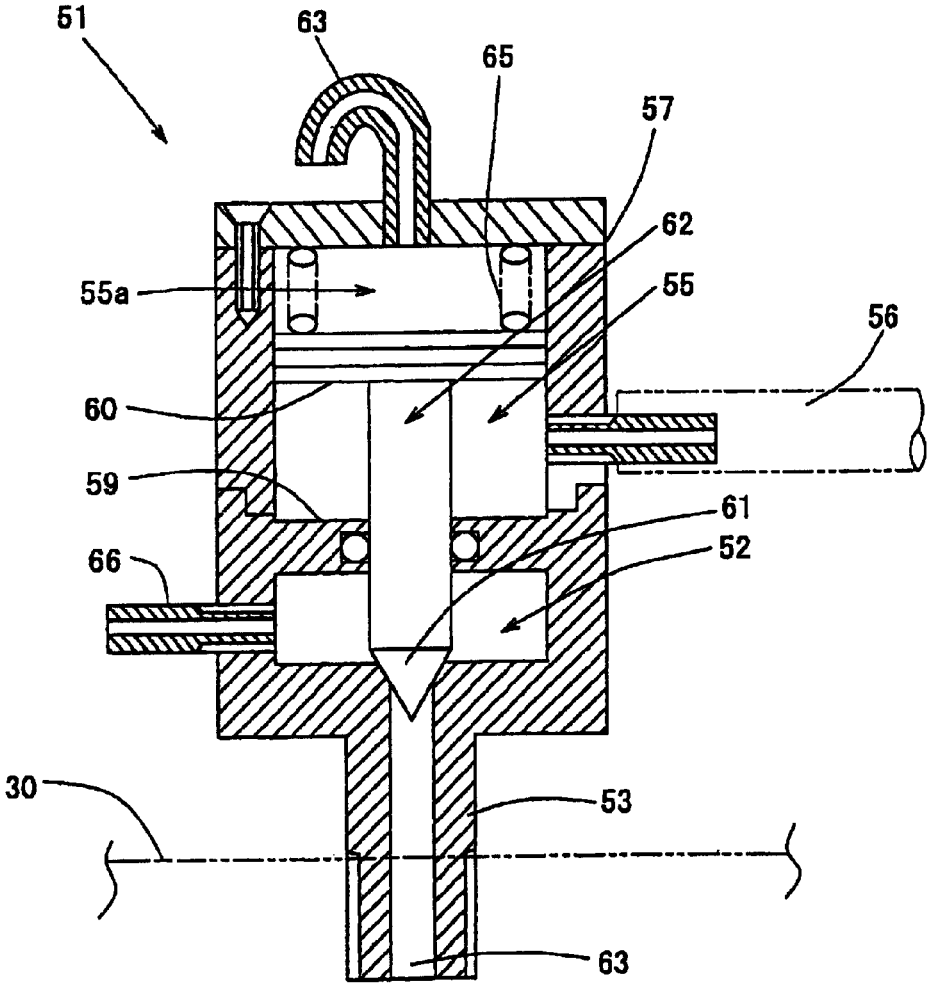
FIG. 6 is a cross section of the intake supply valve of the gas supply device.

The following will describe gas infusion unit 6 with reference to FIG. 3 and 6. As shown in FIG. 6, gas infusion unit 6 comprises intake infusion valve 51 of which injection chamber 52 connects to intake duct 30 through infusion duct 53, and infusion control chamber 55 that connects to discharge duct 20 through control duct 56.

Infusion control chamber 55 and infusion chamber 52 are installed within valve body 57 and vertically separated by chamber wall 59.

Valve 62, which is installed so as to move along the vertical axis within infusion control chamber 55, is formed as a single structure that includes disc-shaped piston 60 and pintle valve 61.

Infusion control chamber 55 includes secondary infusion control chamber 55*a* located above piston 60 which connects to the external atmosphere through vent duct 63, and internally installed spring 65 that applies pressures to valve 65.

In regard to the structure of infusion chamber 52, feed duct (gas supply port) 66 leads from an external device to infusion chamber 52, and valve 62, the lower end at which pintle valve 61 is formed as the valve operating part, is slidably installed through the center of chamber wall 59, thus allowing pintle valve 61 to open or block the port leading to thru-hole (valve orifice) 63 formed in infusion duct 53.

Intake infusion valve 51 operates by directing the pressurized fluid output from discharge port 3 to infusion control chamber 55 through control duct 56, thus raising valve 62 when the output pressure rises to a level that exceeds the predetermined control pressure applied to piston 60 by spring 65. The upward movement of valve 61 opens infusion duct 53 to allow the gas (air) supplied to infusion chamber 52 from feed duct 66 to be drawn into the fluid in intake port 2 (FIG. 5).

Also, when the fluid pressure within infusion control chamber 55 falls below the predetermined spring pressure, valve 62 returns to a closed position due to atmospheric pressure being applied to spring pressure. Therefore, gas is not injected when the pump is operating with low fluid pressure in pump chamber 9, a condition which can result, for example, from the reduced flow volume during pump start-up or from a blockage in the intake system. Therefore, the termination of gas infusion at this time hastens the buildup of fluid pressure in the pump.

Furthermore, because gas infusion automatically stops due to the drop in fluid pressure when pump 1 stops running, damage is prevented which would otherwise occur as a result of starting pump 1 with residual gas remaining in the pump.

Moreover, as shown in FIGS. 2 and 3, constricting device 70, which is installed in discharge port 20 on the downstream side of fluid pressure detection orifice 67 which joins to control duct 56, generates an initial outflow resistance within discharge duct 20 that, especially when the pump is first turned on, makes it possible for fluid pressure to build up quickly within pump chamber 9.

In other words, the structural example of restrictor 70 described in the drawings is formed as a ring-shaped member that extends inward from the internal perimeter of discharge duct 20, the extent to which it protrudes into discharge duct 20 can be altered by operating adjustment screw 71 of discharge pressure adjusting device 72.

If constricting device 70 protrudes a large amount, it significantly restricts the flow through discharge duct 20, thereby allowing fluid pressure within pump chamber 9 to build-up quickly when impeller wheel 5 begins rotating at pump start-up. The fluid pressure is conveyed to infusion control chamber 55 through fluid pressure detection orifice 67 and control duct 56, thereby increasing the pressure within infusion control chamber 55 to the extent where valve 62 rises to open valve orifice 63, thus allowing air from an external device to be injected into intake duct 30 through feed duct 66, infusion chamber 52, and valve orifice 63.

Disregarding conditions in which the outflow system connected to discharge duct 20 includes a nozzle, hose, or the like, this structure allows pump 1 to provide highly stable output of gas-infused fluid, thereby increasing the performance of various types of washing and treatment operations that use a gas-infused liquid.

Moreover, although the drawings describe constricting device 70 as being structured to allow its adjustable protrusion into discharge duct 20 through the use of discharge pressure adjusting device 72, constricting device 70 may be fixedly installed within discharge duct 20 to provide partial blockage of the passage therein.

Figure 7:
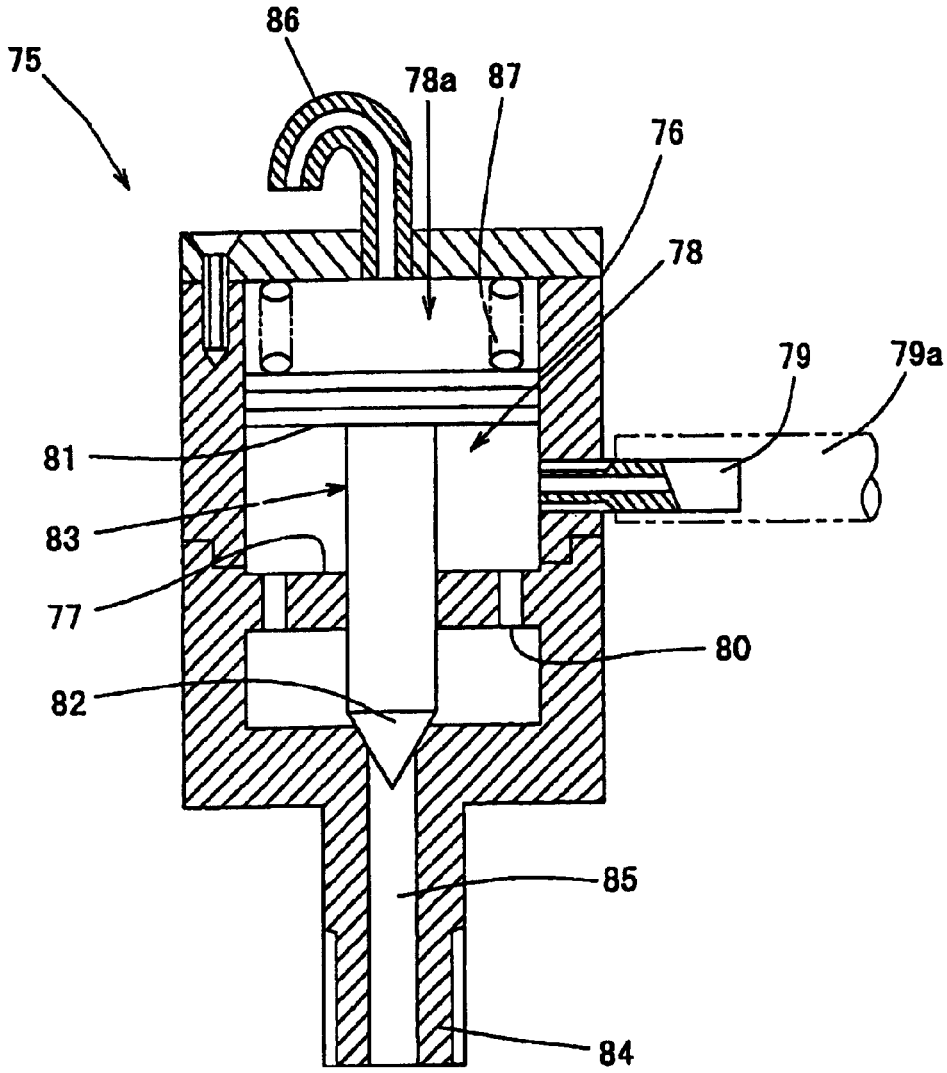
FIG. 7 is a cross section showing the structure of the relief valve.

Furthermore, relief valve 75 (shown FIG. 7) is installed to discharge port 3 in order to prevent damage to the pump which could be caused by excessive pressure within pump chamber 9.

To explain more fully, relief valve 75 includes sealed main valve body 76, which can be opened to the external environment, and separator wall 77 formed within main valve body 76. Two spaces are provided in the form of upper and lower pressure monitoring chambers 78, and thru-holes 80, which are formed within separator wall 77, connect the upper and lower chambers.

Pressure monitoring chamber 78 connects to intake duct 30 through bypass duct 79*a* which joins to exhaust duct 79. Disc-shaped piston 81 and valve 83, the lower end of valve 83 being formed as pin-shaped pintle valve 82, are able to move vertically to open normally sealed exhaust orifice 85 of exhaust duct 84 through the removal of pintle valve 82 there from.

Spring 87 is installed within secondary pressure monitoring chamber 78*a* so as to apply downward pressure against valve 83, and monitoring chamber 78*a* is connected to the external environment through vent duct 86. Relief valve 75 is removably installed through the connection of exhaust duct 84 to installation orifice 20*a* on discharge duct 20 which connects to discharge port 3.

Relief valve 75, thus structured, allows valve 83 to rise up and open exhaust orifice 85 when the pressure within pump chamber 9 rises to a level exceeding the predetermined pressure applied by spring 87, thus allowing part of the fluid to flow into pressure monitoring chamber 78 through thru-holes 80 and back into intake duct 30 through bypass duct 79*a*.

The operation of relief valve 75 prevents the buildup of fluid pressure beyond a predetermined value, improves the air infusion operation, and prevents excessive loads from being applied to impeller wheel 5 in pump chamber 9 as well as the seals and metal components. Moreover, should the pressure within pump chamber 9 fall below a specific pressure, spring 87 once again moves valve 83 downward to seal pintle valve 82 against exhaust orifice 85, thus allowing pump 1 to operate normally in a stable running condition.

Furthermore, in cases where an excessive load has been applied to the hose system connected to discharge port 3, or where constrictor device 70 has been erroneously operated, relief valve 75 will prevent damage to the hoses and impeller wheel 5.

The following will describe the operation and application of pump 1 and its operation therein. The rotation of impeller wheel 5, which is driven by a power source, results in impeller vanes 19 drawing in fluid from intake port 2 into impeller chambers 27 which continually fill pump chamber 9 with fluid moving in a rotational path.

The fluid is forced into and increasingly pressurized within impeller chambers 27 while moving along pressure face 36 in compression chamber 33, and when reaching divider wall 35, is expelled through discharge port 3 at an extremely high pressure generated by the shape of pressure face 36 and rotation of impeller vanes 19 that apply discharge pressure and centrifugal force to the fluid.

Pressure divider wall 35, which is formed at the end of compression chamber 33, extends along multiple impeller chambers 27, and includes pressure divider extension wall 35*a* formed as an extending part of pressure divider wall 35. Moreover, because discharge port 3, which is located at the rotational upstream side of intake port 2, is formed as an elongated orifice extending over multiple impeller vanes 27, it becomes possible to contain the fluid within multiple impeller chamber 27 of impeller wheel 5 in a pressurized state, and at the same time to expel the fluid from the elongated orifice of discharge port 3, thus resulting in a simple structure providing an increase in both fluid flow volume and pressure.

Furthermore, impeller wheel 5 is formed as a single integrated structure comprising impeller vanes 19, boss 27*a*, and impeller plate 26 wherein impeller vanes 19 are rearwardly inclined in a radial arrangement; the side and perimeter of each impeller vane chamber 27, which is formed as the area between adjacent impeller vanes 19, is open; and discharge port 3 is formed in perimeter wall 17 of impeller wheel case 4*b* at a location opposing impeller chambers 27. As a result of this structure, the fluid within pump chamber 9 is securely held within each impeller chamber 27, increasingly pressurized in the rotational direction, and smoothly expelled from discharge port 3 due to centrifugal force. Moreover, as shown in FIG. 5, each impeller vane 19 is preferably structured with its front surface, which faces the rotating direction, oriented so as to form a specific scooping angle, its base part formed to a thicker cross section than the tip part, and with a large radius formed on the rear side of the base part in order to strengthen the impeller vane and improve fluid discharge performance.

Because pump 1 is equipped with a gas infusion structure in the form of gas infusion unit 6 that injects a gas into intake port 2 based on an increase in fluid pressure from discharge port 3, an increase in the fluid discharge pressure at discharge port 3, resulting from the operation of pump 1, will result in the automatic infusion of air and its mixing in with fluid at discharge port 3.[1] Therefore, a decrease in fluid pressure will cause gas infusion unit 6 to stop the infusion of air, prevent a further drop in fluid pressure which would result from air being injected when the pump is running with low fluid pressure in pump chamber 9, and suppress the entrance of residual gas within pump chamber 9.

Due to pump 1 being equipped with discharge duct 20 and constricting device 70 that increases the fluid pressure within pump chamber 9 (pump chamber 9 comprising impeller wheel 5 and pressure block 16), constricting device 70 restricts the fluid exiting through discharge duct 20, thus accelerating the rise in fluid pressure within pump chamber 9 when the pump is initially operated (excluding the effect of flow resistance generated by a connected hose system), and thus promotes the smooth mixing in of air supplied by gas infusion unit 6 during the initial discharge of fluid.

Relief valve 75 prevents a rise in flow pressure above a set value within discharge duct 20, thus maintaining the flow pressure within pump chamber 9 at an approximately uniform pressure that does not rise above the set value, thereby providing for the smooth infusion of air from gas infusion unit 6.

Also, a drop in fluid pressure below a specific value causes relief valve 75 to close, thus promoting a smooth rise in fluid pressure during the normal operation of pump 1. Moreover, even if constricting device 70 of gas infusion unit 6 were to be erroneously adjusted, damage to impeller wheel 5 and other problems would be prevented because excessive fluid pressure is not allowed to build up in pump chamber 9.

Therefore, as a result of the air supplied to this type of pump 1 structure mixing into increasingly pressurized fluid driven by impeller vanes 19 across pressure face 36 within narrowing compression chamber 33, fluid pressure and the spinning action break down the large air bubbles entering from intake port 2 into very small and uniformly sized air bubbles that are mixed into the fluid and discharged therewith. Compared to a conventional air infusion type pump, the present centrifugal pressurization pump invention is able to provide a greater volume of infused air and more stable operation.

Therefore, the invention is able to improve the performance of all types of water-based cleaning processes such as water washing, aerating, and other operations.

Moreover, pump 1 includes pressure differential ridge 39, which is formed on pressure face 36 in the region between intake port 2 and pressure divider wall 35, in order to alter the direction of flow of fluid and gas toward impeller vanes 19, and is thus able to guide the downstream flow of fluid and air moving over compression face 36 into impeller chambers 27, and expel the media flow from discharge port 3 without a decrease in pressure. This structure decreases noise and improves pump efficiency by suppressing incoherent flow at the boundary region which would otherwise result from a large volume of air flowing between pressure divider wall 35 and impeller vanes 19.

Pump 1, with pressure differential ridge 39 being formed on compression face 36, makes it possible to increase the air component to 30% or more of fluid volume. Furthermore, when a large volume of air is mixed in by pump 1, a fluid comprising a liquid and very small bubble component may be continually discharged, thus aiding in the operation of various types of processes in which the pump is used.

While the operation of the embodied pump 1 equipped with the aforesaid air infusion device has been described with reference to air as the infusion gas, the infusion gas is not limited to air, but may also take the form of various types of gasses including gasses into which particulate matter has been mixed in as well as pharmaceutical, digestive, nutritional fluids and the like, thus making the pump applicable to a wide range of uses in various fields.

Figure 9:
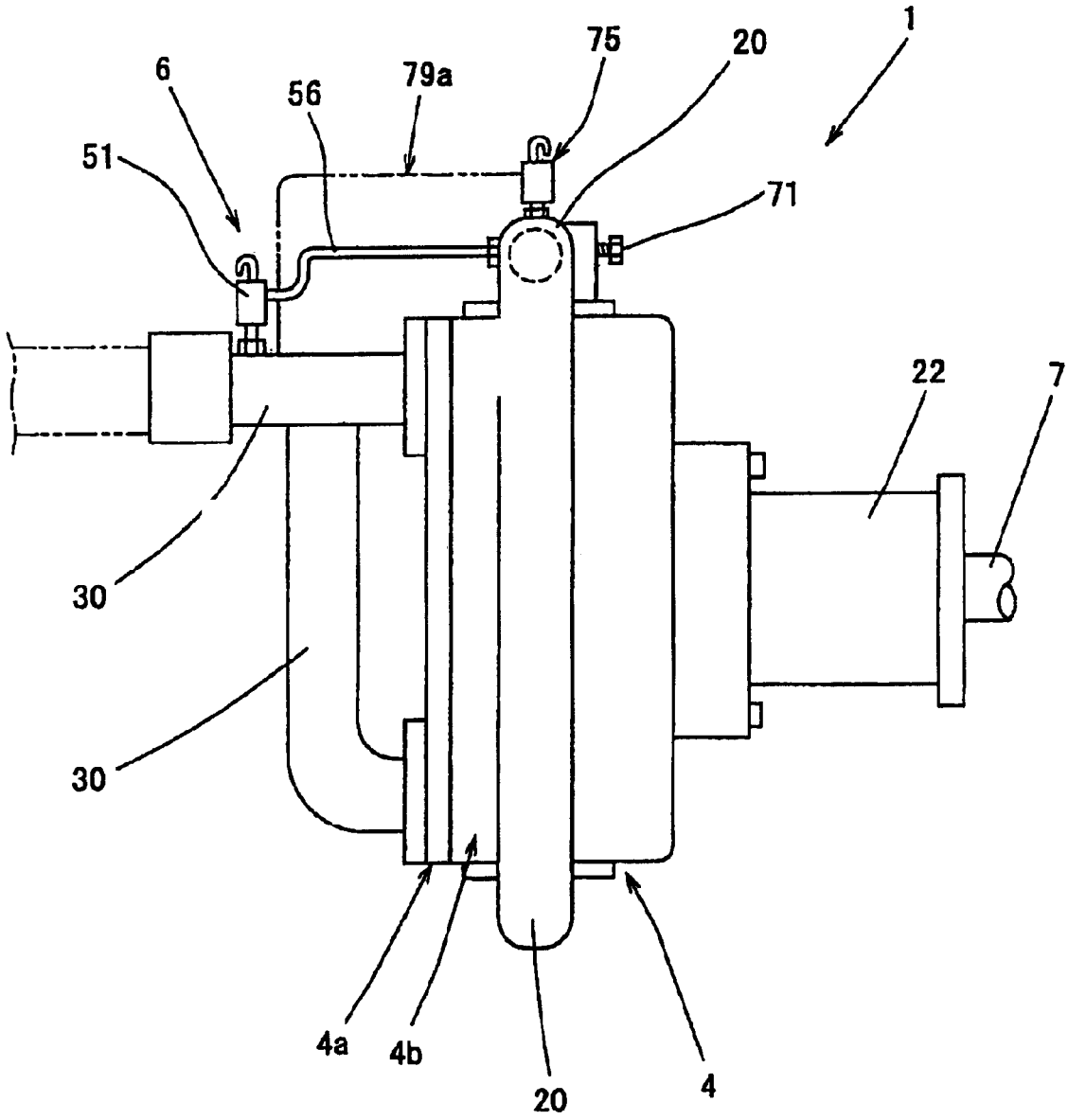
FIG. 9 is a plan view of an additional embodiment of the centrifugal pressurization pump and gas infusion structure.
Figure 10:
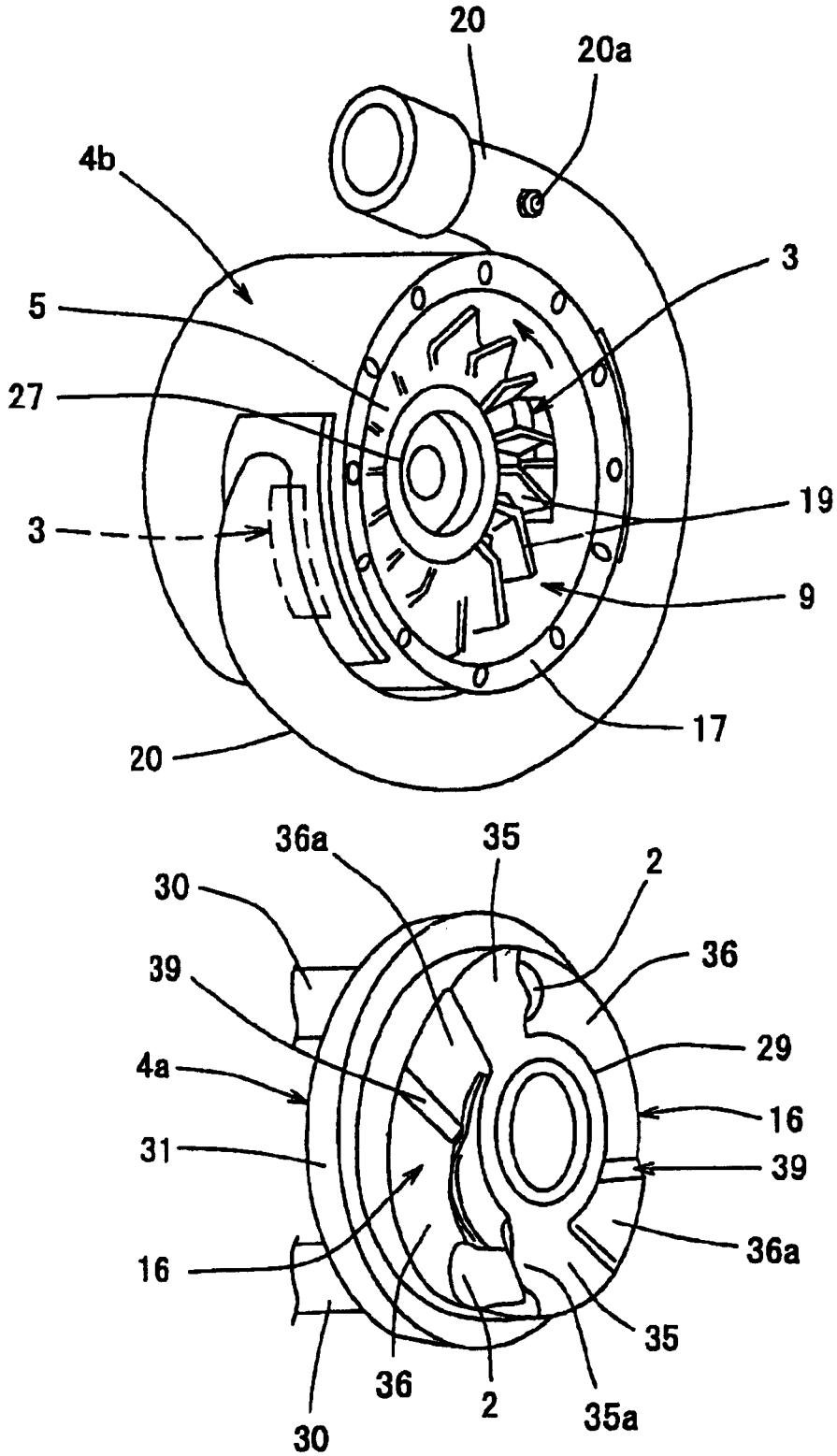
FIG. 10 is perspective view of the case structure of the FIG. 9 pump.

The following will describe an additional embodiment of the pump 1 invention with reference to FIGS. 9 and 10. Descriptions of structures and components essentially similar to those described in the previous embodiment have been omitted.

In this additional embodiment, pump 1 incorporates two interconnected compression chambers 33, two pressure blocks 16, two discharge ports 3, and two intake ports 2 oppositely disposed to impeller wheel 5 which is supported by a shaft in case 4 in a disposition similar to that of the previous embodiment, thus providing a simple pump structure capable of drawing in and expelling a large volume of fluid through a single impeller wheel 5, and of injecting a gas into the flow of fluid through gas infusion unit 6, and of discharging said fluid.

In other words, this embodiment of pump 1, as described in the drawings, incorporates two interconnected compression chambers 33, two intake ports 2, and two discharge ports 3, each pair of upper and lower intake and right and left discharge ports being symmetrical disposed along the radial axis.

FIG. 9 illustrates pressure case 4*a* to which two input ducts 30 are symmetrically attached at upper and lower positions thereon, and pressure block 16 located opposite to and covering half of the radial area of impeller wheel 5. Pressure block 16 includes a compression chamber 33, an intake port 2, a compression face 36, a pressure differential ridge 39, a secondary compression face 26*a*, and a pressure divider wall 35. Furthermore, this illustration describes two intake ducts 30, each of which is connected to a respective intake port 2, and each of which branches off from a common intake duct 30.

Impeller wheel case 4*b* incorporates a pair of upper and lower discharge ports 3, each to which a discharge duct 20 is attached. Each discharge port 3 is located opposite to a respective pressure differential ridge 39 formed on each of the two pressure blocks 16. The discharge duct 20 connecting to the opening of one discharge port 3 extends around in the discharge direction to join to a discharge duct 20 connecting to the other discharge port 3.

With this structure, the liquid entering the two intake ports 2 flows through symmetrically formed compression chambers 33 and pressure blocks 16 and is discharged, under pressure, from each discharge port 3 in the same manner as described for the previous embodiment.

By equipping pump 1 with a single impeller wheel 5 and multiple compression chambers 33 and pressure blocks 16, each compression chamber 33 being equipped with an intake port 2 and discharge port 3, pump 1 is a simple structure incorporating multiple pump chambers 9, and can thus be manufactured at reduced cost.

In this embodiment of pump 1, intake duct 30 and discharge duct 20 are structured similarly to their corresponding structures in the previous embodiment, and are similarly respectively equipped with intake infusion valve 51 of gas infusion unit 6, relief valve 75, and constricting device 70.

Therefore, this type of pump 1 structure allows the gas from gas infusion unit 6 to be injected into intake duct 30 and mix in with the fluid in each pump chamber 9, thus allowing a large volume of gas-infused fluid to be discharged from discharge ports 3.

Although this embodiment describes pump 1 as being equipped with two pump chambers 9, enlarging the diameter of impeller wheel 5 allows the use of more than two pump chambers 9 while still maintaining the ability to easily manufacture pump 1, and makes it possible to freely design each pump chamber 9 to obtain desired performance characteristics. Moreover, intake duct 30 and discharge duct 20 can be independently attached to the intake port 2 and discharge port 3 of each pump chamber 9, thereby allowing a single pump 1 to intake fluid from multiple locations or discharge fluids to multiple locations.

Benefits Provided by the Invention

The following benefits are provided as a result of the above-described gas infusion structure for a centrifugal pressurization pump.

Cavitation is prevented, the discharge of a highly gas-infused fluid is aided, and residual gas is prevented from remaining within the pump chamber, when the pump is not running, as a result of the gas infusion unit supplying a gas or like substance to the pump chamber, through the intake port, based on fluid pressure at the discharge side of the pump, and as a result of the gas supply being stopped when fluid pressure drops.

Moreover, the constricting device installed in the discharge duct provides a simple method of restricting the outflow of fluid from the pump chamber, thus accelerating the build-up of fluid pressure in the pump chamber during initial operation of the pump, and thereby controlling the infusion of gas from the infusion unit at initial fluid discharge.

The relief valve installed to the discharge duct prevents a rise in fluid pressure in the pump chamber above a predetermined level, thus permitting easier gar infusion while aiding in the prevention of damage to the impeller wheel, hoses, and other pump system components.

Furthermore, the gas and fluid are mixed and subsequently discharged from the discharge port, without a drop in fluid pressure, due to the pressure differential ridge altering the flow of fluid and gas along the compression face between the inlet port and pressure divider wall. Also, the supplied gas is discharged without continually rotating and remaining within the pump chamber.

The invention claimed is:

1. A gas substance infusing structure for a centrifugal pressurization pumps, comprising:

a drum-shaped case in which an intake port and a discharge port are formed, and to which is installed an impeller wheel including a plurality of radially disposed impeller vanes;

a compression face defining a narrowing compression chamber opposing the impeller vanes from the intake port side facing the impeller wheel; and a pressure block on which is formed a pressure divider wall that prevents the leakage of fluid from within impeller chambers formed between the sides of impeller vanes, wherein the fluid entering the centrifugal pressurization pump from the intake port is pressurized within a pump chamber formed by the impeller wheel and pressure block and discharged through the discharge port, and wherein a gas infusion unit supplies a gas to the intake port based on increased fluid pressure at the discharge port.

2. The gas or like substance infusing structure for a centrifugal pressurization pump according claim 1, wherein a constricting device is provided within the discharge duct which connects to the discharge port, said constricting device configured to increase the fluid pressure within the pump chamber.

3. The gas or like substance infusing structure for a centrifugal pressurization pump according to claim 1, wherein a relief valve is installed to the discharge duct to prevent fluid pressure within the pump chamber from rising above a predetermined level.

4. The gas or like substance infusing structure for a centrifugal pressurization pump according claim 1, wherein a pressure differential ridge is formed on the compression face that extends from the inlet port to the pressure divider wall said pressure differential ridge being formed as an acutely inclined partial surface that diverts the flow of fluid and gas toward the impeller vanes.

5. The gas or like substance infusing structure for a centrifugal pressurization pump according to claim 2, wherein a relief valve is installed to the discharge duct to prevent fluid pressure within the pump chamber from rising above a predetermined level.

6. The gas or like substance infusing structure for a centrifugal pressurization pump according to claim 2, wherein a pressure differential ridge is formed on the compression face that extends from the inlet port to the pressure divider wall, said pressure differential ridge being formed as an acutely inclined partial surface that diverts the flow of fluid and gas toward the impeller vanes.

7. The gas or like substance infusing structure for a centrifugal pressurization pump according to claim 3, wherein a pressure differential ridge is formed on the compression face that extends from the inlet port to the pressure divider wall, said pressure differential ridge being formed as an acutely inclined partial surface that diverts the flow of fluid and gas toward the impeller vanes.

8. The gas or like substance infusing structure for a centrifugal pressurization pump according to claim 5, wherein a pressure differential ridge is formed on the compression face that extends from the inlet port to the pressure divider wall, said pressure differential ridge being formed as an acutely inclined partial surface that diverts the flow of fluid and gas toward the impeller vanes.

* * * * *